US006297800B2

(12) United States Patent
Dagman

(10) Patent No.: US 6,297,800 B2
(45) **Date of Patent: *Oct. 2, 2001**

(54) PERFORMING COLOR ADJUSTMENTS ON IMAGE DATA

(75) Inventor: Vadim Dagman, Mountain View, CA (US)

(73) Assignee: Dazzle Multimedia, Inc., Fremont, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/149,904

(22) Filed: Sep. 8, 1998

(51) Int. Cl.[7] ..... G09G 5/04

(52) U.S. Cl. ..... 345/153; 345/150; 345/151; 345/152; 345/154

(58) Field of Search ..... 345/150, 151, 345/152, 153, 154

(56) References Cited

U.S. PATENT DOCUMENTS 5,712,659 * 1/1998 Adachi ..... 345/150
5,877,754 * 3/1999 Keith et al. ..... 345/154
5,920,299 * 7/1999 Ohshima et al. ..... 345/152
5,920,358 * 7/1999 Takemura ..... 345/153
5,920,659 * 11/1999 Iverson et al. ..... 345/154
5,986,642 * 11/1999 Ueda et al. ..... 345/150
5,990,858 * 11/1999 Ozolins ..... 345/154

* cited by examiner

*Primary Examiner*—Richard Hjerpe
*Assistant Examiner*—Ali Zamani
(74) *Attorney, Agent, or Firm*—Blakely, Sokoloff, Taylor & Zafman LLP

(57) ABSTRACT

A method and apparatus for performing color adjustments on video being captured is described. In one embodiment, a current color adjustment request is generated in response to user input. The current color adjustment parameter value for the color adjustment request is cached. Then a message is posted to video capture hardware to stop the capture process. The color is adjusted after the capture process has been stopped using the color adjustment parameter values associated with the color adjustment request and any color adjustment requests that occur while waiting for the capture process to stop.

22 Claims, 3 Drawing Sheets

INITIALIZE FLAG
201
RECEIVE COLOR ADJUSTMENT REQUEST
202
STORE ADJUSTED COLOR PARAMETER VALUE
203
O/S QUEUES THE REQUEST
204
IS FLAG > 0 ?
205
YES
NO
INCREMENT FLAG
206
CAPTURE RUNNING ?
207
NO
YES
STOP CAPTURE PROCESS
208
INDICATE CAPTURE IS STOPPED
209
INDICATION MADE ?
210
NO
YES
WRITE COMMAND DIRECTLY TO VIDEO HARDWARE
211
DECREMENT FLAG
212
RESTART CAPTURE, IF NECESSARY
213
RETURN
214

PERFORMING COLOR ADJUSTMENTS ON IMAGE DATA

FIELD OF THE INVENTION

The present invention relates to performing color adjustment (brightness, sharpness, etc.) on an image data; more specifically, the present invention relates to performing color adjustments to images generated using a video decoder during continuous capture of video.

BACKGROUND OF THE INVENTION

Today, computer systems that individually display video images usually allow individuals to make color adjustments. These color adjustments may include, for example, brightness, sharpness, tint and saturation. These individuals often expect to see the continuous color adjustments made immediately as they are watching the display.

Many video recording devices capture video at the same time the video images are being viewed. For example, one such device captures video and encodes the captured video data to generate MPEG encoded video, while allowing an individual to preview the captured images on a display and make color adjustments to those images. The preview is performed by decoding in MPEG encoded video on the system as it is being received. The user desires the preview of images to run seemingly uninterrupted, thereby showing the color adjustments nearly instantaneously. Likewise, the user desires the capture process to also run seemingly uninterrupted.

Some encoders may make color adjustments through programming. These encoders are often in video capture devices. For instance, if the capture device has a VRP MPEG encoder sold by C-Cube, programming color adjustments may be made by sending color adjustment commands to the encoder itself. However, to make the color adjusts, the user must stop the capture process. Continuous color adjustment is not quite possible because stopping and restarting MPEG capture process is a relatively long operation. In fact, the stopping the capture process is much longer than the time between two consecutive color adjustment requests coming from the requesting application.

Another constraint on some encoders is that the microcode being executed on the encoder cannot be interrupted in the middle of the sequence without corrupting the data. If the capture device has only one interface to the system, the sending of captured video and the receiving of programming must be over the same interface. If programming is sent to the capture device at the same time the capture device is executing its microcode or captured video is being sent over the shared interface, then the data may become corrupted. Therefore, to avoid corruption of data in the prior art, the capture process is stopped along with the video preview that is occurring. With the process stopped, the color adjustments cannot be viewed as they are occurring.

Another complication occurs when that MPEG capture process is controlled by a driver that is messages-driven. In this case, a request to stop the capture process means posting a message to the driver and waiting in a message loop until it is executed. This creates a re-entrancy problem when another color adjustment request is made while the previous request hasn't been completed yet.

The present invention provides for performing color adjustments without corrupting video data being captured and without corrupting programming being sent for making color adjustments. Also embodiments of the present invention are able to avoid the re-entrancy problems described above.

SUMMARY OF THE INVENTION

A method and apparatus for performing color adjustments on video being captured is described. In one embodiment, a current color adjustment request is generated in response to user input. The current color adjustment parameter value for the color adjustment request is cached. Then a message is posted to the video capture hardware to stop the capture process. The color is adjusted after the capture process has been stopped using the color adjustment parameter values associated with the color adjustment request and any color adjustment requests that occur while waiting for the capture process to stop.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

Figure 1:
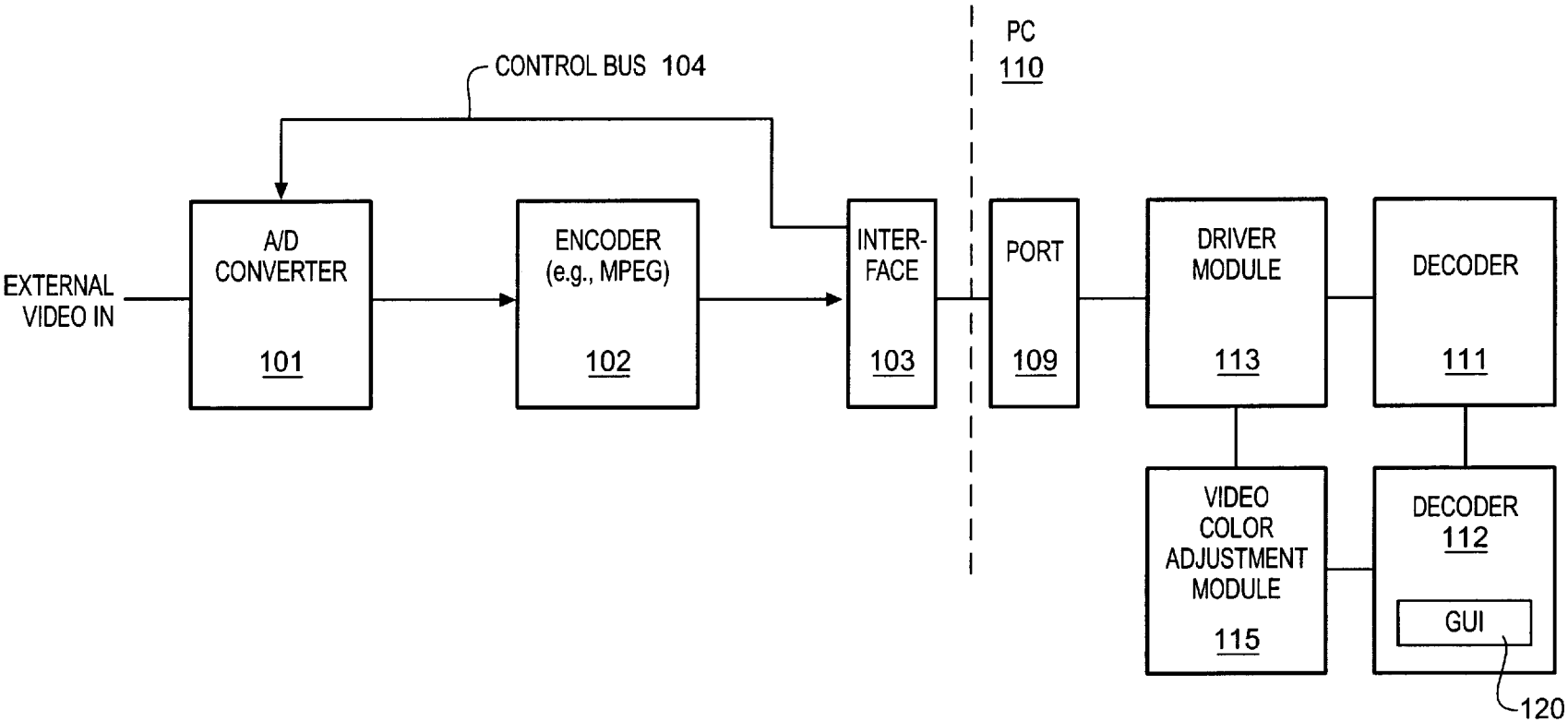
FIG. 1 is a block diagram of one embodiment of a system.

A method and apparatus performing color adjustments to video data is described. In the following description, numerous details are set forth. It will be apparent, however, to one skilled in the art, that the present invention may be practiced without these specific details. In other instances, well-known structures and devices are shown in block diagram form, rather than in detail, in order to avoid obscuring the present invention.

Some portions of the detailed descriptions described below are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "processing" or "computing" or "calculating" or "determining" or "displaying" or the like, may refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Also as discussed below, the present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magneto-optical disks, read-only memories (ROMs), random access memories (RAMs), EPROMs, EEPROMS, magnetic or optical cards, or any type of media suitable for storing electronic instructions, and each coupled to a computer system bus. The algorithms presented herein are not inherently related to any particular computer or other apparatus. Various general purpose machines may be used with programs in accordance with the teachings herein, or it may prove convenient to construct more specialized apparatus to perform the required apparatus steps. The required structure for a variety of these machines will appear from the description below. In addition, the present invention is not described with reference to any particular programming language. It will be appreciated that a variety of programming languages may be used to implement the teachings of the invention as described herein.

Overview

The present invention performs color adjustments on video images while video data is being captured. In one embodiment, the captured image data is first encoded and subsequently sent to a decoder which decodes the image data and sends the decoded image data to a display for previewing. The color adjustments include, but are not limited to, brightness, sharpness, tint and saturation. As an individual is previewing the video, the user can select color adjustments using a graphical user interface (GUI) and the selected color adjustments occur continuously as the user views the images. In one embodiment, a slider, or slide bar, on the GUI is used to indicate the color adjustments.

Note that the color adjustments do not cause data corruption, even when the video capture device and the system previewing the captured video share the same interface. This is because, prior to programming the hardware on the video capture device, the color adjustment process ensures that the video capture process is stopped. In one embodiment, the capture process is stopped by posting a message to the video capture hardware.

In one embodiment, the capture process is an MPEG capture process that is performed by an external adapter which captures video, encodes the video to create MPEG encoded video and sends the MPEG encoded video over an interface to a computer system. The MPEG capture process is message driven. In such a case, to stop the video capture process, a message is posted to request the capture process be stopped. In one embodiment, this message is posted to the driver for the adapter. After posting the message, the color adjustment process waits in a message loop to allow the system to send the message to the driver. Upon receipt, the driver stops the capture process at an appropriate time, ensuring that no data corruption occurs. Once the driver stops the capture process, the actual color adjustments are made.

The present invention also avoids the re-entrancy problem that occurs when receiving another color adjustment request while already waiting in the message loop for the driver to stop the capture process. In one embodiment, the color adjustment parameter values are cached and any new color adjustment value received while the system in the message loop waiting for the capture process to be stopped is cached as well, such that by the time the actual color adjustments are to be made, all of the color adjustments may be made with the most recent color adjustment parameter values. Thus, the same parameter value may be changed a number of times from the first change of the first color adjustment request. However, only the most recently cached change is made.

System Overview

FIG. 1 is a block diagram of one embodiment of a system. The system may be a computer or other multimedia system, or a portion thereof. Referring to FIG. 1, the system comprises a video capture path having a video analog-to-digital (A/D) converter 101, an encoder 102 coupled to the video A/D converter 101, and an interface 103 coupled to encoder 102 and coupled to A/D converter 101 via a control bus 104. The output of interface 103 is coupled to computer system 110. In one embodiment, A/D converter 101, encoder 102 and interface 103 comprise an external adapter that couples to computer system 110 via a parallel port.

System 110 includes a decoder 111 that is coupled to receive the video stream. In one embodiment, decoder 111 comprises MPEG decoding software executing on computer system 110. A display 112 is coupled to the output of decoder 111 to display decoded data.

Blocks shown in FIG. 1 may be implemented in hardware (e.g., dedicated hardware), software that runs on a general purpose or dedicated computer system or machine, or a combination of both. To the extent portions of the system are implemented in software, the coupling between blocks may comprise transferring data between software modules or providing data at a location for access by another module by using an address or other suitable identifier of the location storing the data.

During operation of the video capture path, video signals are sampled by video A/D converter 101 to generate samples of captured digital video data. The samples of captured video data are compressed by encoder 102. In one embodiment, encoder 102 comprises an encoder, such as, for example, a VRP MPEG encoder sold by C-Cube, that generates MPEG encoded video capable of being decoded by a decoder adhering to the MPEG-1 specification, such as decoder 111. Encoder 102 is not limited to being an MPEG encoder and, in other embodiments, may be any encoder such as, for instance, an encoder that encodes data according to another standard. The compressed video data is sent to interface 103 which forwards the data to system 110. In one embodiment, interface 103 sends video data directly to system 110 using a parallel port.

Driver module 113 accesses data captured by the video capture path via port 109. When captured data is available, interface 103 sends an interrupt to computer system 110. In response to the interrupt, driver module 113 accesses captured video from the video capture path. One or more buffer storage areas may be included to temporarily store digitized video data and/or compressed video data read from the video capture path by driver module 113. In one embodiment, the captured data comprises a stream of MPEG encoded video.

The compressed data (e.g., compressed MPEG stream) is received by decoder 111. Decoder 111 decodes the compressed stream to create decoded video data. The decoded video data is forwarded to display 112 which displays the decoded video. Decoder 111 may be used to decode the encoded video data while it is being retrieved from the video capture path in order to preview the video being captured.

System 110 also includes a graphical user interface (GUI) 120 shown on display 112. GUI 120 includes an adjustment slider, or slide bar, or other input mechanism to indicate desired color adjustments. More than one adjustment slider or input device may be used. Sliders, or slide bars, are well-known in the art. In such an embodiment, an adjustment slider may be provided for each type of color adjustment that the user is allowed to make (e.g., brightness, sharpness, tint, saturation, etc.). Note that any system input interface to indicate the desired color adjustments may be used. In one embodiment, a color adjustment request is issued by GUI 120 every time the user moves the adjustment slider.

In response to movements of the adjustment slider on GUI 120, video color adjustment module 115 causes the color adjustments of the color adjustment requests to be performed. In response to the color adjustment request, video color adjustment module 115 generates a programming message for programming hardware in the video capture path. In one embodiment, video color adjustment module 115 also stores the one or more color parameter values that have been modified in memory for use later when actually performing the color adjustments. An indication (e.g., dirty bit) may be stored as well to indicate whether a value has been changed. Such an indication may be particularly advantageous where multiple modified color parameter values may be stored and must be accessed and an indication of which parameter values have been changed. In one embodiment, this programming is forwarded to the video capture path to program A/D converter 104.

In one embodiment, programming is done by the video color adjustment module 115 writing the programming commands to the same parallel port from which MPEG encoded data is read from the video capture path. This write operation may be to a port address. Any access to the parallel port during transfer of the MPEG encoded data may cause data corruption or malfunctioning of the encoder the microcode that the encoder is executing. To prevent this, the MPEG capture process is stopped before sending the color adjustment programming commands to the video capture path.

In operation, when the user drags the adjustment slider, he/she would ideally expect continuous color adjustment. The present invention provides for near simultaneous display of the color adjustments as well as accommodating additional color adjustment requests that are generated while the previous request hasn't completed.

The present invention provides a solution that is as responsive to the user as possible. Responsiveness is achieved by caching color adjustment requests while waiting in the message loop for the capture process to stop, so that when the software finally starts adjusting the color, it will use the latest set of adjustment parameter values that were requested.

Figure 2:
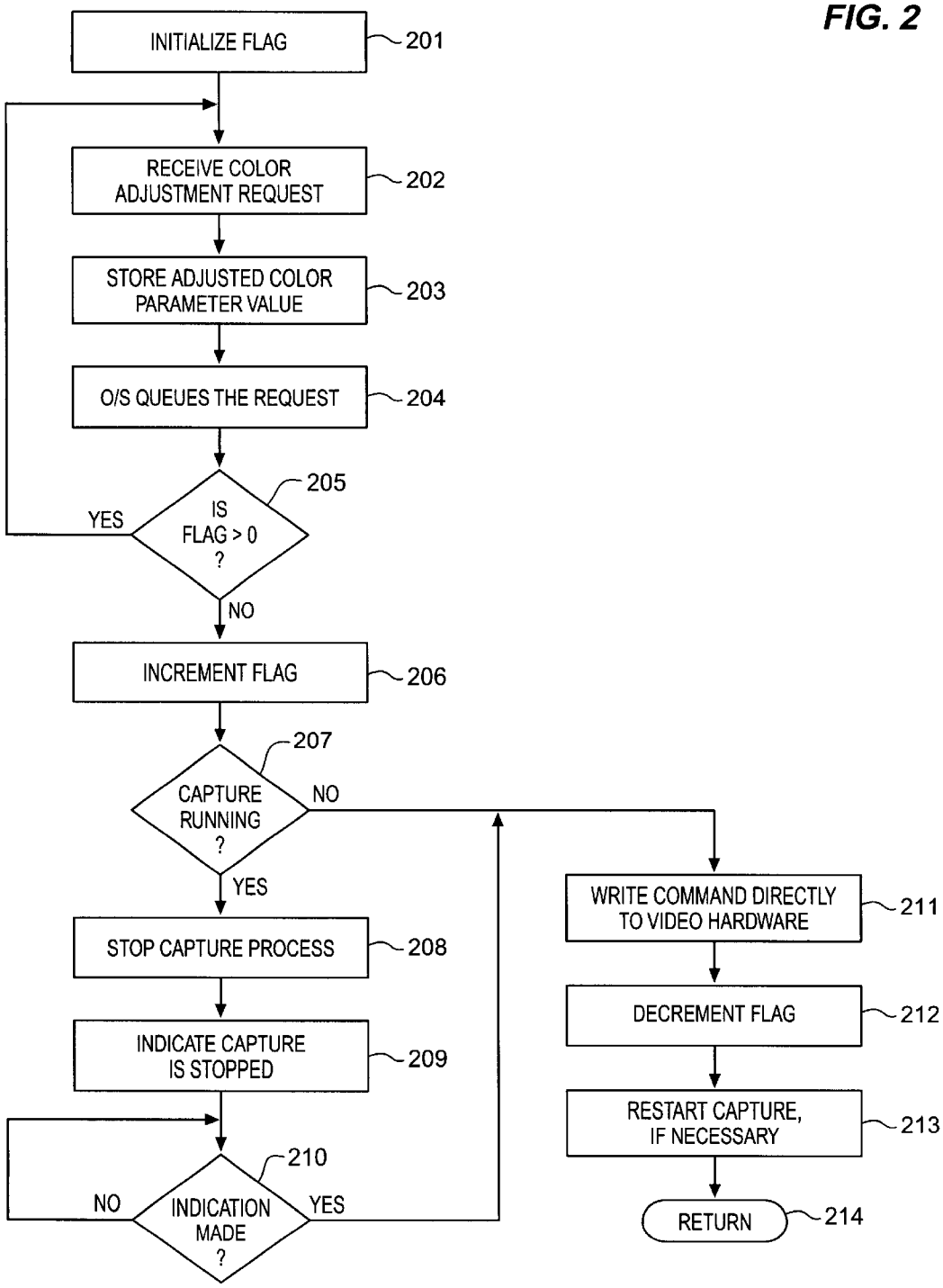
FIG. 2 is a flow diagram of one embodiment of a process for performing color adjustments to video data.

One embodiment of a process for performing color adjustments is described in FIG. 2. The process is performed by processing logic, which may comprise software running on general purpose or dedicated computer system or machine, or may comprise dedicated hardware, or a combination of both.

Referring to FIG. 2, the process begins by processing logic initializing a flag that is used to indicate whether the color adjustment process has been entered and is still executing (processing block 201). In one embodiment, the flag is an integer flag that is initially set to zero.

Next processing logic receives a color adjustment request (processing block 202). The color adjustment request may be generated in response to a user moving a slider on a graphical user interface to indicate one or more desired color adjustments. In response to the color adjustment request, processing logic accumulates the color adjustment parameter value(s) specified in the color adjustment request. In one embodiment, processing logic marks each color adjustment parameter as changed and stores the new parameter value in memory. In one embodiment, the application (e.g., video color adjustment module 115) responsible for performing the color adjustments marks the color adjustment parameter as changed by setting its dirty bit to a predetermined value (e.g., 1). Thereafter, the operating system sends the color adjustment request to an applications queue (processing block 204).

Processing logic then tests whether the flag is greater than a predetermined value (processing block 205), thereby indicating that the color adjustment function has already been entered and is still executing. In one embodiment, the predetermined value is 0.

If the flag is greater than a predetermined value, indicating that the color adjustment function has already been entered and is still executing, then processing transitions to processing block 202. Note that the parameter value associated with the color adjust request will be adjusted as part of the already executing color adjust process.

If the color adjustment function is not still executing from previously being entered, then processing transitions to processing block 206 where the processing logic increments the flag. Then processing logic determines whether the capture process is still running (processing block 207). In one embodiment, this determination may be made by monitoring one or more flags, or other indications, that are set when the capture process is stopped. In one embodiment, the state of the driver module is maintained after every command and may be examined to determine if the capture process has been stopped.

If the capture process is not running, then processing transitions directly to processing block 211. If the capture process is still running, processing transitions to processing block 208 where processing logic stops the capture process. In one embodiment, the application responsible for performing color adjustments posts a message to have the video capture hardware stop the capture process. In one embodiment, the message is sent to the driver module of the video capture hardware to stop the driver module. Once the driver module is stopped, the video capture process will be stopped without corrupting data because the driver module will not stop the capture process until it has completed reading any available captured data. Until the capture process stops, processing is in a wait state.

When the capture process is stopped, the driver module generates an indication notifying the system that the capture process has been stopped (processing block 209). In one embodiment, the indication may comprise a datum set by the driver module for the operating system or applications queue. Such an indication may be sent to the operating system. In an alternate embodiment, this indication may comprise a signal sent from the video capture path to the system. Processing logic continuously tests whether the indication has been made (processing block 210).

After the indication has been made, processing logic writes a command directly to the video capture hardware (processing logic 214). In one embodiment, the processing logic writes to a port address associated with the video capture hardware. Programming commands are written to program the hardware with each color adjustment parameter that has been modified. In one embodiment, a single command may be used to program the hardware with more than one modified color adjustment parameter value. In one embodiment, A/D converter 101 is programmed with the commands that are written to a port address and are sent to A/D converter via control bus 104 from interface 103 (e.g., parallel port).

After adjusting the color, processing logic decrements the flag indicating that the color adjustment process has already been entered and is still executing (processing block 212). Thereafter, processing logic restarts the capture process if the capture process was on when the color adjustment occurred (processing block 213) and returns from the function (processing block 214). Processing logic determines whether to restart the capture process by examining a flag that indicates that the capture process was stopped earlier. To restart the capture process, the color adjustment application sends another message to the driver for the video capture hardware.

Pseudo code for the embodiment of the color adjustment function described in FIG. 2 is given below:

```
static int Flag = 0          // Marks that function was entered and is still
                             // executing
Accumulate Color Adjustment request: mark particular
    color adjustment parameter as changed and remember its value to
    be set later.
if (Flag > 0)
{
    // We have been reentered.
    • Return from the function.
}
Increment the Flag
For each color adjustment parameter that is marked as changed
{
    If capture is running
    {
        Stop the capture - that's where we get into message loop
        waiting until capture is really stopped.
    }
    Adjust the color
}
Decrement the Flag
If preview was running and stopped in that function
{
    Restart the capture.
}
    Return from the function.
```

Figure 3:
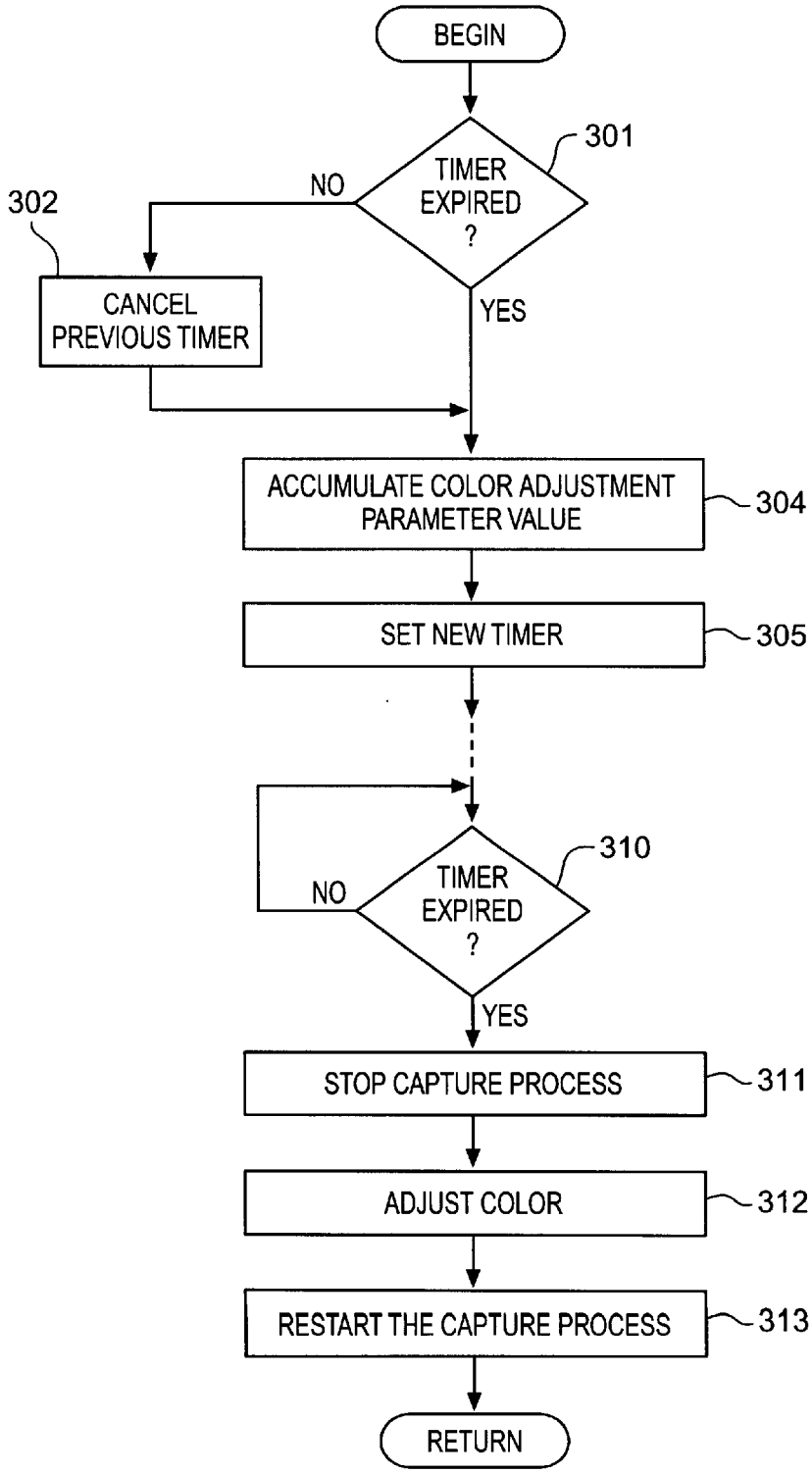
FIG. 3 is a flow diagram of an alternate embodiment of a process for performing color adjustments to video data.

FIG. 3 is a flow diagram of an alternative embodiment of a process for performing the color adjustment. The process shown in FIG. 3 avoids a re-entrancy problem associated with another color adjustment request being generated while a previous request hasn't yet completed. The re-entrancy problem is avoided by deferring the color adjustment (the whole sequence of stopping the capture, adjusting the color, and then restarting the capture) from the moment it was requested by the application program for a period of time longer than is usually required for the color adjustment sequence to execute. In this way, if a new adjustment request is issued by the application while the color adjustment sequence is in progress, the current sequence won't be re-entered and the new request gets executed at a later time when the previous color adjustment sequence (e.g., stopping the capture process, performing the color adjustment, and restarting the capture process) has been already completed.

In one embodiment, the period of time is controlled by a timer. In one embodiment, the timer may be a software timer.

The process of FIG. 3 may be divided into two separate functions. Referring to FIG. 3, after receiving a color adjustment request, the process begins by processing logic determining whether a previously set timer has already expired (processing block 301). If not, then processing logic cancels the currently running timer (processing block 302) and transitions to processing block 304. The timer was originally started in response to an earlier color adjust request is canceled in favor of another timer that is to be set up. If the previously set timer has already expired, then processing transitions directly to processing block 304.

Next, processing logic accumulates the color adjustment parameter value specified in the color adjustment request (processing block 304). In one embodiment, processing logic marks the color adjustment parameter value as changed and stores the new parameter value. In one embodiment, the color adjustment parameter value is marked as changed by setting its dirty bit to a predetermined value (e.g., 1). After accumulating the modified color adjustment parameter value, processing logic sets a timer for a predetermined time (processing block 305). The amount of time for the timer is set to be at least as long as the actual color adjustment sequence to execute (e.g., the process of stopping the capture process, performing the color adjustment, and restarting the capture process). In one embodiment, the timer is set for 300 milliseconds.

Processing logic monitors to see when the timer times out (processing block 310). In one embodiment, the operating system monitors the timer and calls a call back function when the timer expires. When the timer expires, processing logic stops the capture process if it is running (processing block 311). As discussed above, in one embodiment to stop the capture process a message is posted to the driver for the capture hardware and the system waits in a message loop until it gets executed and a notification is received indicating that the capture process has been stopped.

Once the capture process has been stopped, processing logic adjusts the color for each parameter that is marked as changed (processing block 312). In one embodiment, the process of adjusting the color for each parameter may involve repeatedly reading one of the cached parameter values to see if it has been changed and then changing that parameter if a change had occurred. In one embodiment, processing logic reads the dirty bit for each parameter value to determine if it has been changed and then changes the parameter values for only those with modified dirty bits. In one embodiment, the driver module examines the dirty bits and/or the parameter values to see which have been changed.

After the color adjustments have been made, processing logic restarts the capture process if it had to be stopped to perform the color adjustment(s) (processing block 313). The process then ends.

Pseudo code for the embodiment described in FIG. 3 is given below.

```
Adjust Color Function
{
    If previous timer hasn't elapsed yet
    {
        Cancel the timer - we're going to setup another one below
    }
    • Accumulate Color Adjustment request: mark particular
    color adjustment parameter as changed and remember its value to
    be set later.
    • Setup a timer for 300 ms (long enough for the
    actual color adjustment sequence to execute)
}
```

-continued

```
Timer handler function
{
    Stop capture if it's running (wait here in a message loop
    until capture is actually stopped)
    For each color adjustment parameter that is marked as changed
    {
        Adjust the color
    }
    Restart the capture if it was running
}
```

Note that the computer system 110 is shown in simplified form. In one embodiment, system 110 includes a bus or other communication device for communicating information, a processor (or other processing device) coupled to the bus for processing information, a random access memory (RAM) or other dynamic storage device (referred to as main memory), coupled to the bus, for storing information and instructions to be executed by the processor. The main memory also can be used for storing temporary variables or other intermediate information during execution of instructions by the processor. In one embodiment, the memory stores the operating system, application program, including the color adjustment program, driver software and software timer modules. The memory also stores the modified color parameter values, modified or not, and their dirty bits. Separate memories may be used for storing the programs and data.

System 110 may also include a read only memory (ROM) and/or other static storage device coupled to the bus for storing static information and instructions for the processor. A data storage device may be coupled to the bus for storing information and instructions. The data storage device may comprise a magnetic disk or optical disc and corresponding drive. The display device may be a liquid crystal display (LCD) for displaying information to a user. An input device may be included in system 110 allows a user to provide input and control. The input device can be, for example, a keyboard, a keypad, a mouse, a trackball, a trackpad, a touch-sensitive screen, etc. The input device would enable a user to interact with the graphical user interface.

The interface 103 may interface to the bus via a bus bridge or other interface to the video capture hardware.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

Thus, a method and apparatus for performing color adjustments have been described.

I claim:

1. A method for performing color adjustments on video being captured, the method comprising:

generating a first color adjustment request in response to user input;

caching a first color adjustment parameter value for the first color adjustment request;

monitoring an indicator to determine if the capture process is activated;

posting a message at a driver module to stop the capture process;

accumulating color adjustment parameter values for color adjustment requests that occur while waiting for the capture process to stop; and adjusting the color after the capture process has been stopped using one or more color adjustment parameter values associated with the first color adjustment request and any color adjustment requests that occur while waiting for the capture process to stop.

2. The method defined in claim 1 wherein caching the first color adjustment parameter value comprises storing a color adjustment parameter value with an indication for the first color adjustment parameter value to indicate that the value has been modified.

3. The method defined in claim 1 wherein the color is adjusted with a second color adjustment parameter value from another color adjustment request that is generated after the first color adjustment request, wherein the second color adjustment parameter value is different than the first color adjustment and both are of the same parameter.

4. The method defined in claim 1 wherein posting a message to stop the capture process and adjusting the color is repeated for each modified color parameter value.

5. The method defined in claim 1 further comprising restarting the capture process.

6. An apparatus for performing color adjustments on video being captured, the method comprising:

means for generating a first color adjustment request in response to user input;

means for caching a first color adjustment parameter value for the first color adjustment request;

means for monitoring an indicator to determine if the capture process is activated;

means for posting a message at a driver module to stop the capture process;

means for accumulating color adjustment parameter values for color adjustment requests that occur while waiting for the capture process to stop; and means for adjusting the color after the capture process has been stopped using one or more color adjustment parameter values associated with the first color adjustment request and any color adjustment requests that occur while waiting for the capture process to stop.

7. The apparatus defined in claim 6 wherein means for caching the first color adjustment parameter value comprises means for storing a color adjustment parameter value with an indication for the first color adjustment parameter value to indicate that the value has been modified.

8. The apparatus defined in claim 6 wherein the color is adjusted with a second color adjustment parameter value from another color adjustment request that is generated after the first color adjustment request, wherein the second color adjustment parameter value is different than the first color adjustment and both are of the same parameter.

9. The apparatus defined in claim 6 wherein posting a message to stop the capture process and adjusting the color is repeated for each modified color parameter value.

10. The apparatus defined in claim 6 further comprising means for restarting the capture process.

11. A computer system product including a recordable storage medium storing a plurality of instructions, when executed by a processing device, cause the processing device to:

generate a first color adjustment: request in response to user input;

cache a first color adjustment parameter value for the first color adjustment request;

monitor an indicator to determine if the capture process is activated;

post a message at a driver module to stop the capture process;

accumulate color adjustment parameter values for color adjustment requests that occur while waiting for the capture process to stop; and adjust the color after the capture process has been stopped using one or more color adjustment parameter values associated with the first color adjustment request and any color adjustment requests that occur while waiting for the capture process to stop.

12. The computer system defined in claim 11 wherein the processing device caches the first color adjustment parameter value by storing a color adjustment parameter value with an indication for the first color adjustment parameter value to indicate that the value has been modified.

13. The computer system defined in claim 11 wherein the color is adjusted with a second color adjustment parameter value from another color adjustment request that is generated after the first color adjustment request, wherein the second color adjustment parameter value is different than the first color adjustment and both are of the same parameter.

14. The computer system defined in claim 11 wherein the processing device posts a message to stop the capture process and adjusts the color for each modified color parameter value.

15. The computer system defined in claim 11 further comprising instructions which when executed by the processing device cause the processing device to restart the capture process.

16. A system comprising:

a video capture path;

a video color adjustment module coupled to the video capture path; and a display coupled to both the video capture path and the video color adjustment module to display video, wherein the display displays a graphical user interface allowing user to specify a first color adjustment request, wherein the video color adjustment module caches a first color adjustment parameter value for the first color adjustment request, posts a message to stop the capture process being performed by the video capture path, accumulates color adjustment parameter values for color adjustment requests that occur while waiting for the capture process to stop, and adjusts the color after the capture process is stopped using one or more color adjustment parameter values associated with the first color adjustment request and any color adjustment request that occur while waiting for the capture process to stop.

17. The apparatus defined in claim 16 further comprising a driver module coupled to the video color adjustment module wherein the video color adjustment module posts a message to the driver module to stop the capture process.

18. The apparatus defined in claim 17 wherein the video capture path comprises an external adapter having an analog to digital converter to sample video data and an encoder to encode the sampled video data.

19. The apparatus defined in claim 18 wherein the video color adjustment module generates programming to program the analog to digital converter.

20. A method for performing color adjustments on video being captured, the method comprising:

generating a first color adjustment request in response to user input;

canceling a previously existing timer set in response to a second color adjustment request made prior to the first color adjustment request if the previously existing timer has not expired;

caching a color adjustment parameter value for the color adjustment request;

setting a new timer in response to the first color adjustment request;

when the timer expires, posting a message to stop the capture process performed by video capture hardware;

adjusting the color after the capture process has been stopped; and restarting the capture process.

21. An apparatus for performing color adjustment, the apparatus comprising:

means for generating a first color adjustment request in response to user input;

means for canceling a previously existing timer set in response to a second color adjustment request made prior to the first color adjustment request if the previously existing timer has not expired;

means for caching a color adjustment parameter value for the color adjustment request;

means for setting up a new timer in response to the first color adjustment request;

means for posting, when the timer expires, a message to stop the capture process;

means for adjusting, when the timer expires, the color after the capture process has been stopped; and means for restarting, when the timer expires, the capture process.

22. A computer software product including a recordable medium storing instructions which, when executed by a processing device, cause the processing device to:

generate a first color adjustment request in response to user input;

cancel a previously existing timer set in response to a second color adjustment request made prior to the first color adjustment request if the previously existing timer has not expired;

cache a color adjustment parameter value for the color adjustment request;

set up a new timer in response to the first color adjustment request;

when the timer expires, post a message to stop the capture process;

adjust the color after the capture process has been stopped; and restart the capture process.

* * * * *